US005564816A

United States Patent [19]

Arcadia et al.

[11] Patent Number: 5,564,816

[45] Date of Patent: Oct. 15, 1996

[54] ILLUMINATED MEMORIAL ASSEMBLY

[76] Inventors: Alexander J. Arcadia, 251 Township Line Rd., Douglassville, Pa. 19518; Theresa P. North, 205 Whisper Ct., Burlington, N.J. 08016

[21] Appl. No.: 425,891

[22] Filed: Apr. 21, 1995

[51] Int. Cl.[6] ..... F21V 33/00

[52] U.S. Cl. ..... 362/183; 362/121; 362/802; 362/276; 362/191; 362/806; 362/253; 52/104

[58] Field of Search ..... 362/183, 276, 362/1, 802, 32, 121, 253, 202, 190, 191, 311, 356, 158, 806, 808; 52/103, 104; 40/124.5

[56] References Cited

U.S. PATENT DOCUMENTS

| | | | |
|---|---|---|---|
| 676,853 | 6/1901 | Schlacks | 362/121 |
| 1,294,279 | 2/1919 | Kugel | 362/121 |
| 1,391,945 | 9/1921 | Flagge | 362/121 |
| 2,019,192 | 10/1935 | Minkel | 362/121 |
| 2,132,297 | 6/1936 | Horowitz . | |
| 2,325,883 | 8/1943 | Schleif | 362/121 |
| 2,917,853 | 12/1959 | Lawsyk . | |
| 4,169,970 | 10/1979 | Opiela | 179/100.1 |
| 4,200,904 | 4/1980 | Doan | 362/183 |
| 4,281,369 | 7/1981 | Batte | 362/183 |
| 4,319,310 | 3/1982 | Kingsley | 362/183 |
| 4,384,317 | 5/1983 | Stackpole | 362/183 |
| 4,410,930 | 10/1983 | Yachabach | 362/145 |
| 4,453,201 | 6/1984 | Prouty | 362/121 |
| 4,843,525 | 6/1989 | Williams | 362/157 |
| 5,013,972 | 5/1991 | Malkieli | 315/209 |
| 5,014,472 | 5/1991 | Svensson | 52/103 |
| 5,065,291 | 11/1991 | Frost | 362/183 |
| 5,155,668 | 10/1992 | Tanner | 362/183 |
| 5,164,654 | 11/1992 | Bertram | 320/61 |
| 5,174,645 | 12/1992 | Chung | 362/86 |
| 5,255,170 | 10/1993 | Plamp | 362/183 |
| 5,404,343 | 4/1995 | Boggio | 360/12 |

*Primary Examiner*—Denise L. Gromada
*Assistant Examiner*—Thomas M. Sember
*Attorney, Agent, or Firm*—LaMorte & Associates

[57] ABSTRACT

An illuminated memorial for use at a grave site comprised of an opaque hollow structure that defines an interior chamber. An aperture extends into said hollow structure exposing a portion of the hollow chamber. The hollow structure itself is preferably formed from metal and is shaped and reinforced in its structure to resist physical damage from vandals. A light source is contained within hollow structure proximate the aperture, whereby light emitted by said light source is directed through said aperture. The light source is powered by at least one rechargeable battery. A photovoltaic source is supported at the highest point of the hollow structure, wherein said photovoltaic source converts light into electricity and recharges the rechargeable batteries during daylight conditions.

19 Claims, 4 Drawing Sheets

ILLUMINATED MEMORIAL ASSEMBLY

BACKGROUND OF THE INVENTION

1. Field of the Invention

The present invention relates to memorials for the dead. More particularly, the present invention relates to illuminated memorials with solar panels that enable the memorial to recharge its own power source during the day, whereby the power source maintains the illumination of an internal light source at night.

2. Statement of the Prior Art

Many cultures use memorials at grave sites to memorialize the dead. A common such memorial is the tombstone wherein the person's name, date of birth, date of death and perhaps a brief personal message are carved into the stone. Due to religious beliefs and/or superstition, cemeteries are commonly considered places to be avoided at night or during inclement weather conditions. One of the reasons that may have lead to this fearful reputation is that cemeteries are often not well lit. As such, during the night and during inclement weather, cemeteries appear dark, dreary and uninviting. Because cemeteries are not well lit, cemeteries have often become subject to vandalism, wherein tombstones have been desecrated, damaged or toppled.

One of the primary reasons that cemeteries are not well lit is that cemeteries typically are not wired for electricity to a public utility. As a result, no electrical power for lighting is available. Another reason why lights are not present in cemeteries is that cemeteries are often very large and the cost of lighting such a large area is prohibitively expensive to a cemetery with limited financial resources.

In the prior art, there have been many devices invented that are intended to bring light to remote locations were there is no access to the public electric utility. Many of these prior art devices are solar powered units that charge batteries during the day and light a light during the night. Such prior art devices are exemplified by U.S. Pat. No. 5,065,291 to Frost et al, entitled MARKING LIGHT and U.S. Pat. No. 4,410,930 to Yachabach, entitled PHOTOVOLTAIC LIGHTING FOR OUTDOOR TELEPHONE BOOTH. The problem with many such solar powered systems are that they are fragile and are easily damaged by vandals. As such, they are not easily adapted for use in a cemetery where vandalism is commonplace. Furthermore, there are no poles or other tall structures in a cemetery upon which solar panels can be mounted. As a result, the solar panels must be mounted near the ground were they can be easily reached and damaged. The mounting of solar panels near the ground also means many shadows from trees, bushes and other grave stones many be cast across the solar panels at different times of the day.

U.S. Pat. No. 5,255,170 to Plamp et al , entitled ILLUMINATED MEMORIAL discloses a prior art solar powered memorial that has many of the disadvantages previously described. In the Plamp patent, a memorial is created using a translucent material such as plastic. Within the plastic structure are disposed a plurality small light emitting diodes that are widely dispersed and only provide a limited amount of illumination. Furthermore, the solar panel is located on the base of the monument where it can easily be kicked, damaged by landscaping equipment and obscured by the overgrowth of grass and weeds. Plastic is not typically known for its high tensile strength or high impact resistance. As such, it should be understood that the monument in the Plamp patent is relatively fragile and can be easily damaged or destroyed by vandals. Furthermore, transparent structures such as those made from glass or plastic provide a very tempting target for vandals throwing stones in an attempt to smash the transparent structure.

The use of multiple small LEDs in a disperse pattern also is problematic because the low degree of light emitted by such an arrangement does little more than dimly illuminate just the memorial. Such lighting arrangements are too dim to illuminate any area surrounding the memorial and are therefore not good sources of ambient lighting. The poor illumination may be even too dim to allow a person to view and read the name and inscription on the memorial. Additionally, when disperse LEDs are used in a transparent structure, a viewer tends to look at the points of the various disperse lights rather than at the memorial itself. From a distance the shape of the memorial may not be discernable at all.

The positioning of a solar panel at ground level in a memorial is highly problematic. First, graves are commonly arranged in rows within the cemetery. As such, new gravestones must be placed in a predetermined place in a predetermined orientation. It is very likely that given the position and orientation of the grave, a solar panel at ground level may not have an unobstructed view of the southern sky. Furthermore, solar panels at ground level are easily obstructed by the shadows cast be surrounding objects and by other things such as overgrown grass, blown leaves, grass cuttings, flowers and the like.

It is therefore a primary objective of the present invention to provide a solar powered illuminated memorial where the solar panel is elevated to the highest point on the memorial and can be oriented in any direction desired.

It is a further object of the present invention to provide an illuminated memorial that is made of metal and is highly resistant to vandalism.

It is yet another object of the present invention to provide an illuminated memorial that has a concentrated source of illumination that is clearly viewed and provides a bright concentrated source of illumination.

Lastly, it is an objective of the present invention to provide an illuminated memorial that can be retroactively added to any existing tombstone.

SUMMARY OF THE INVENTION

The present invention is an illuminated memorial for use at a grave site. The memorial is comprised of an opaque hollow structure that defines an interior chamber. An aperture extends into said hollow structure exposing a portion of the hollow chamber. The hollow structure itself is preferably formed from metal and is shaped and reinforced in its structure to resist physical damage from vandals.

A light source is contained within hollow structure proximate the aperture, whereby light emitted by said light source is directed through said aperture. The light source is powered by at least one rechargeable battery. A photovoltaic source is supported at the highest point of the hollow structure, wherein said photovoltaic source converts light into electricity and recharges the rechargeable batteries during daylight conditions. The photovoltaic source is mounted in a manner that enhances its exposure to the sky and prevents the photovoltaic source from being obscured by snow, plant growth or other common obstructions.

A control circuit is provided that controls the interaction between the light source, the photovoltaic source and the rechargeable battery depending upon ambient lighting conditions.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE PRESENT INVENTION.

Figure 1:
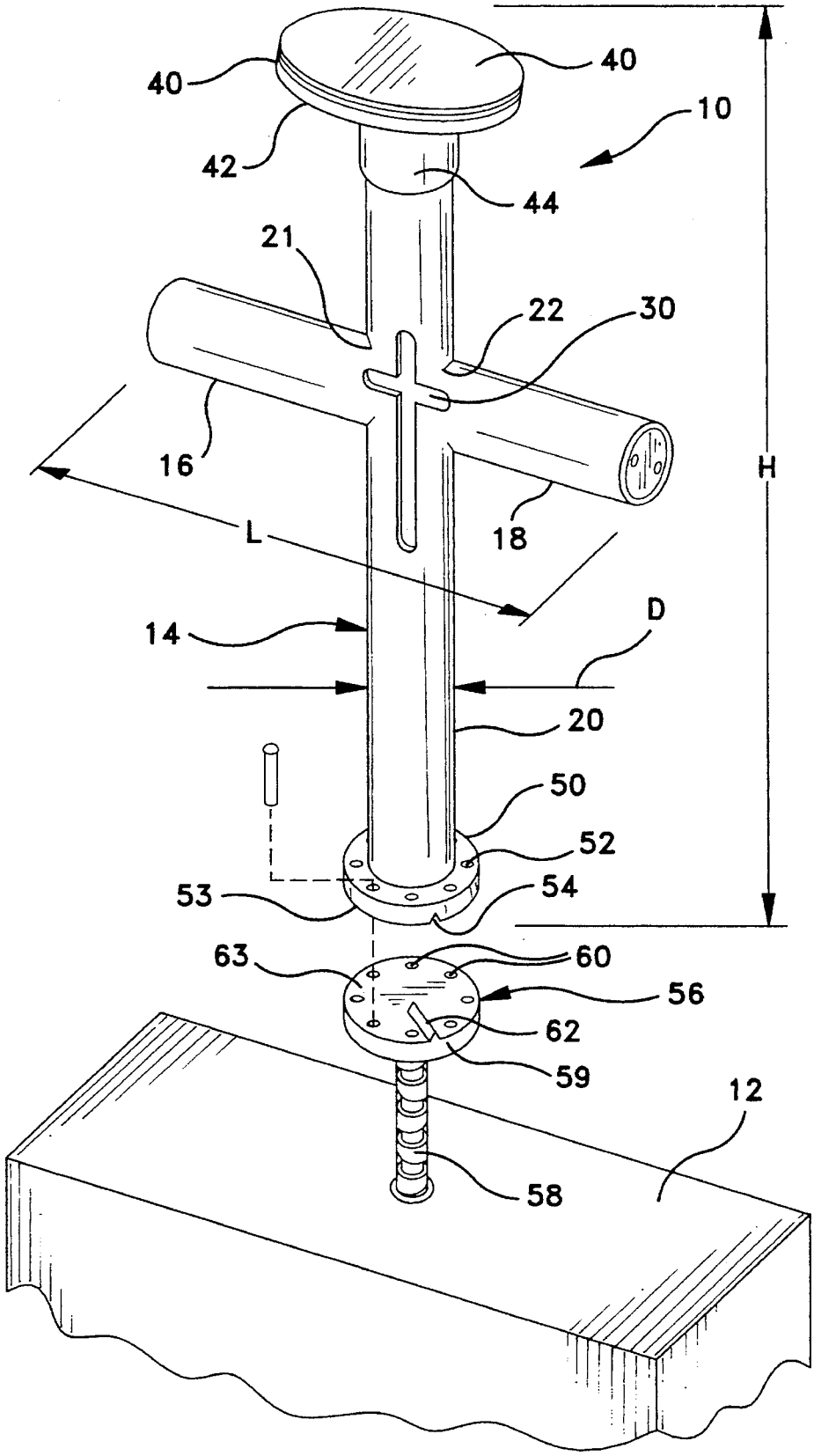
FIG. 1 is a perspective view of one preferred embodiment of the present invention memorial shown in conjunction with a tombstone to facilitate further consideration and discussion of its interned use.

The present invention is a solar powered memorial that can either be used as a grave memorial or can be used in conjunction with a traditional stone grave memorial. Referring to FIG. 1, there is shown a preferred embodiment of the present invention memorial 10 shown mounted to the top of a conventional stone tombstone 12. In the shown embodiment, the present invention memorial 10 is formed as a cross structure 14. However, as will later be explained other religious configurations may also be used. The cross structure 14 is made of tubing, wherein two short pieces of tubing 16, 18 are attached to a long central piece of tubing 20 in order to form the desired cross shape. The tubing can be made of any high strength, corrosive-resistant material such as titanium, tungsten alloy, aluminum alloy, carbon graphite or the like. However, in the preferred embodiment the tubing is made of stainless steel which is relatively low in cost and easy to machine as compared to some of the more exotic alternatives. The use of stainless steel also provides the memorial 10 with a highly reflective appearance that would reflect sunlight during the day and would present an aesthetically pleasant appearance. The thickness of the tubing use to make the cross structure 14 is sufficient enough to provide the overall cross structure 14 with enough strength to resist damage by vandals. For instance, it can be assumed that a vandal may attempt to break the cross structure 14 by either kicking the structure or standing on the structure. The thickness of the tubing should therefore be sufficient to handle such anticipated stresses without damage. Furthermore, the joints 21, 22 that join the short sections of tubing 16, 18 to the long central piece of tubing 20 must also be of sufficient strength to endure the anticipated stresses inflicted by a vandal.

In the shown embodiment, the stainless steel tubing has a diameter D of preferably about 1.5 inches. For such a diameter D, it has been determined that a tubing thickness of approximately 0.0625 inches provides the overall cross structure with enough rigidity to resist vandalism, assuming the overall height H of the cross structure 14 is approximately 14 inches and the overall length L of the cross's arms is approximately 7.25 inches. As the overall height H and length L of the cross structure 14 are changed, obviously the thickness of the tubing could also be changed in a corresponding manner. It has also been determined that by providing a double bevel or single bevel weld, ground smooth, along each of the joints 21, 22, the cross structure 14 is provided with sufficient rigidity to resist damage from a vandal.

An ornamental aperture 30 is formed in the center of the cross structure 14. Although the ornamental aperture 30 could take on any shape, the preferred shape for use in the cross shaped structure 14 would also be that of a cross. As will later be explained, it ornamental aperture 30 is the window though which light is emitted from the memorial 10. By having an ornamental aperture 30 that is shaped like a cross within the larger cross structure 14, the form of the cross is reinforced during the day. Furthermore, in darkness, the light emanating from the ornamental aperture 30 provides the appearance of a cross so that the cross is seen both by day and by night. The use of a single ornamental aperture 30 also provides a single focus point in viewing the memorial at night, wherein the cross-shaped aperture will appear to brightly glow in the darkness.

A solar panel 40 is supported by the cross structure 14. The solar panel 40 lays upon a stainless steel plate 42, wherein the stainless steel plate provides the solar panel with rigidity. The stainless steel plate 42 is welded to an end cap member 44 that attaches to the top end of the long center tube 20 that forms the center of the cross structure 14. The stainless steel plate 42 is supported at an acute angle relative to the horizontal by the end cap member 44. This angle serves a double purpose. First, it enables the solar panel 40 to be more effectively directed toward the southern sky. Secondly, the angle makes the solar panel difficult to stand upon and it prevents leafs, dust, water, snow and other debris from collecting upon the solar panel 40. In the shown embodiment, the solar panel 40 is shown angled toward the back of the cross structure 14. It should be understood that such an orientation is merely exemplary and the angle of the solar panel 40 could be oriented in any direction that would optimize exposure of the sun to the solar panel 40. If the orientation of a particular grave sight is known, a person can order the monument from the factory with the end cap member 44 welded to the cross structure 14 in what ever orientation was most efficient for solar exposure. Alternatively, the top of the long center tube 20 may be threaded, as may the end cap member 44. With both elements being threaded, the end cap member 44 and the solar panel 40 it supports can be threaded onto the cross structure 14 until the solar panel 40 is supported in a proper orientation. To prevent removal of the end cap member 44, the threads of the end cap member 44 may be coated with an epoxy or similar thread sealer prior to its connection to the cross structure 14. In yet another alternate embodiment, specialty fasteners that require special tools to remove, could be used to anchor the end cap member 44 to the cross structure 14 at a desired orientation. Specialty fasteners of this type are commonly uses in assemblies that are traditionally prone to vandalism.

A shatter resistant protective layer 46 is preferably disposed over the solar panel 40. Such a protective layer 46 is made of a transparent material such as plastic and is permanently attached to the solar panel in either an adhesive or mechanical manner. The protective layer 46 prevents direct physical contact with the solar panel 40, thereby preventing damage or wear to the solar panel 40 and hermetically sealing the solar panel 40 from the elements.

The bottom end of the long center tube 20, opposite the end cap member 44, is joined to a mounting flange 50. In the preferred embodiment, the mounting flange 50 is welded to the center tube 20, however alternative mechanical or adhesive based joining techniques may be used. The mounting flange 50 contains a plurality of bolt apertures 52 arranged in a symmetrical pattern. The bottom surface 53 of the mounting flange is flat except for the possible existence of an optional groove 54 that helps to properly orient the cross structure 14 as will be later explained.

The present invention monument 10 can be mounted at a grave in a number of different ways. If the monument 10 is to be retroactively added to an existing tombstone 12, as is shown, a plurality bolts can be set into the tombstone in a pattern matching the bolt aperture pattern on the mounting flange 50. However, setting multiple bolts into a tombstone in an exact pattern can be a difficult undertaking. In a preferred embodiment, a base mount 56 can be used. The base mount 56 contains a single anchor element 58 that is set into the tombstone 12 by drilling a hole into the tombstone and cementing the anchor element into place. A base flange 59 extends from the anchor element 58, wherein multiple threaded mounting bores 60 are provided in the exact orientation needed to match the bolt apertures pattern on the mounting flange 50. A ridge 62 may be present on the top surface 63 of the base flange 59 that would help the installer of the base mount 56 properly orient the base mount 56 with respect to the existing features of the tombstone 12. As the monument 10 was mounted to the base mount 56, the ridge 62 on the base mount 56 would engage the groove 54 on the mounting flange 50. As a result, the installer would be able to easily determine when the memorial 10 was in the proper orientation with respect to both the base mount 56 and the features of the tombstone 12.

Figure 2:
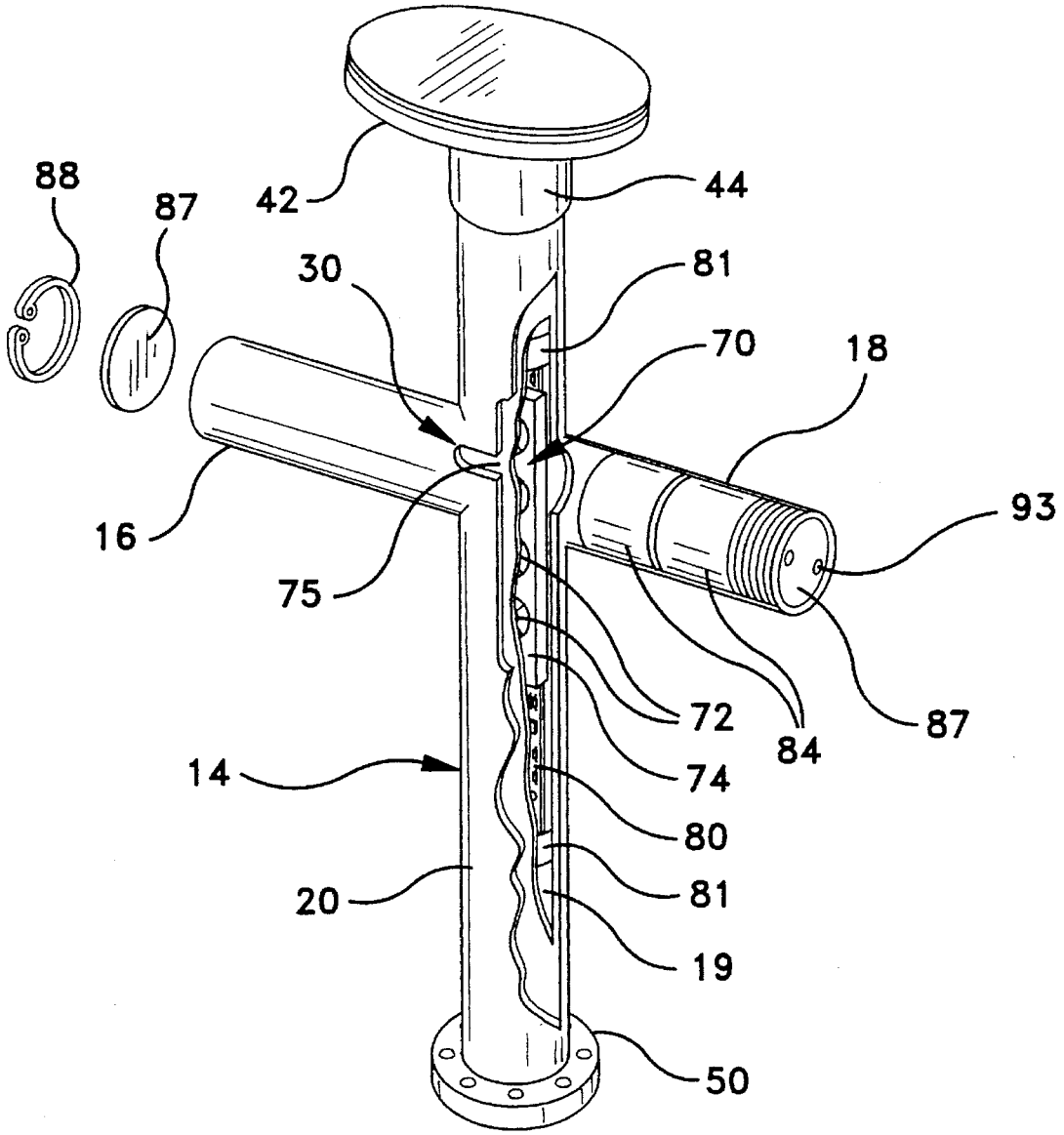
FIG. 2 is a fragmented view of the embodiment of FIG. 1 showing the internal components that comprise the present invention memorial.

Referring to FIG. 2, it can bee seen that the hollow 19 within the cross structure 14 is preferably utilized to hold the various batteries and electronics needed to store electricity during the day and lite the light source 70 during the night. The light source 70 itself can be one of a variety of low wattage lights such as a single cold cathode lamp, a single florescent bulb, or a plurality of light emitting diodes (LEDs). In the shown embodiment, a plurality of LEDs 72 are being used, wherein the LEDs 72 are positioned proximate the ornamental aperture 30 within the long central piece of tubing 20. The LEDs 72 are retained within a reflective housing 74 that is shaped to direct the light emitted by the LEDs 72 toward the ornamental aperture 30.

The ornamental aperture 30 is covered within the cross structure 14 by a translucent light diffuser 75. The diffuser 75 enables the light created by the light source 70 to diffuse across the entire shape of the ornamental aperture 30. As a result, when the ornamental aperture is viewed by a person looking at the memorial, the shape of the ornamental aperture is clearly defined by a relatively even glow of light. The diffuser 75 is preferably made of an impact resistant plastic and can be tinted into any desired color. Consequently, the light passing through the diffuser 75 can be tinted to the color of the diffuser 75. The diffuser 75 covers the ornamental aperture 30 in a substantially water resistant manner. The diffuser 75 could be a semicircular structure mounted over the area of the ornamental aperture 30. However, in the shown embodiment, the diffuser 75 is a hollow tube of translucent plastic that circumvents the inner diameter of the center piece of tubing 20.

A circuit board 80 is supported within the cross structure 14. Cushioned mounts 81 are used to hold the circuit board 80 in place and help to electrically isolate the circuit board 80 from the conductive material forming the cross structure 14. The cushioned mounts 81 also prevent the circuit board 80 from experiencing the expansion and contraction stresses created by the temperature induced expansions and contractions of the stainless steel cross structure 14. As will be later explained, the environment inside the cross structure 14 is hermetically isolated from the ambient atmosphere. However, if such hermetic isolation is not used, it should be understood that the circuit board 80 could be potted and thereby isolated from environmental conditions and contaminants.

As will later be described, the circuit board 80 contains the control circuit that regulates the lighting of the light source 70 and the recharging of the storage batteries 84. In the shown embodiment, the storage batteries 84 are held within the short pieces of tubing 16, 18 that form the arms of the cross structure 14. It will be understood that such positioning is merely exemplary and the storage batteries 84 could also be located in the central piece of tubing 20. One reason why the location of the storage batteries in the arms of the cross structure 14 may be preferable is that each of the pieces of tubing 16, 18 that form the cross's arms are sealed by tube closures 87. These tube closures 87 may be permanent structures, however they also may be made to be selectively removable with some sort of specialty tool. For instance, the tube closures could be held in place by C-clips 88 that engage a groove within each piece of tubing. In such a scenario, a set of C-clip pliers would be required to remove the tube closures. In an alternate embodiment, the tube closures 87 can be threaded to the tubing. Small indents 93 could be disposed in the tube closures 87, wherein the tube closures 87 could be tightened or removed by a specially sized spanner wrench. One advantage of making the tube closures 87 removable is that it would provide access to the storage batteries 84 without requiring that the entire cross structure 14 be removed form place. Accordingly, when the useful life of the storage batteries 84 end, a custodial person at the cemetery or a family member could replace the storage batteries with new ones or even with better ones that my be developed at some point in the future.

The cross structure 14 of the shown embodiment preferably maintains the hollow 19 within the long central piece of tubing 20 in a hermetically sealed condition that is isolated from dust, pollutants and moisture carried in ambient air. The tube closures 87 isolate the interior regions of the short pieces of tubing 16, 18 that form the arms of the cross structure 14. The end cap member 44 and stainless steel plate 42 close the open top end of the central piece of tubing 20. The mounting flange 50 closes the open bottom end of the cross structure 14. Lastly, the diffuser 75 closes the ornamental aperture 30 in the center of the cross structure 14. As a result, there are no open regions on the cross structure 14 through which air and/or water can enter the cross structure 14.

Figure 3:
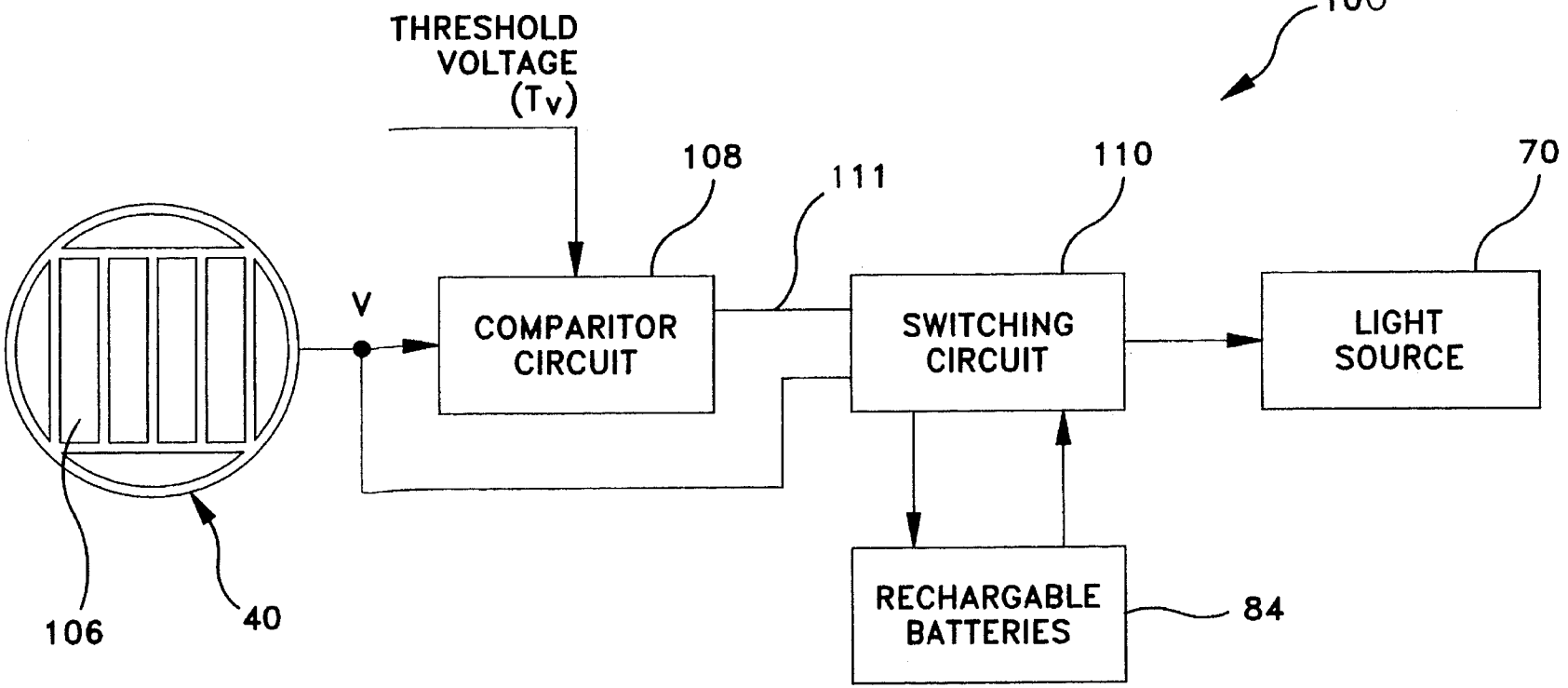
FIG. 3 is a block diagram schematic illustrating a preferred embodiment for the circuit logic for the present invention memorial.

Referring to FIG. 3, there is shown block diagram schematic of a preferred embodiment of a control circuit 100 that controls the operation of the electrical features of the present invention memorial. The purpose of the circuit 100 is to control the flow of electricity to and from both the light source 70 within the memorial and the rechargeable batteries 84, depending upon the conditions of ambient light. During daylight conditions the various photovoltaic cells 106 within the solar panel 40 produce electricity having a variable voltage V that varies in response to the intensity of the sun, as experienced by the solar panel 40. The voltage V produced by the solar panel 40 is compared to a threshold voltage $T_v$ by a comparitor circuit 108. As will be explained, it is the comparative voltage difference between the solar panel voltage V and the threshold voltage $T_v$ that determines the overall operation of the control circuit 100. Normally, during daylight conditions, the voltage V produced by the solar panel 40 is greater than that of the threshold voltage $T_v$.

However, as the sun sets or if a storm approaches, the voltage V of the solar panel 40 drops below that of the threshold voltage $T_v$. The threshold voltage $T_v$ may be a factory set value, however in alternate embodiments, the threshold voltage $T_v$ may be variable. A variable threshold voltage $T_v$ would enable adjustments for unforeseen on-site conditions. For instance, suppose a grave was located near a street with a street light. By varying the threshold voltage $T_v$ the control circuit 100 can be finely adjusted to those lighting conditions so that the threshold voltage $T_v$ is greater than the solar panel voltage V at night and is less than the solar panel voltage V during the day. The threshold voltage $T_v$, however, should always be at least as high as the voltage of the storage batteries 84 when fully charged.

A switching circuit 110 controls the flow of electricity between the solar panel 40 and the storage batteries 84 and between the storage batteries 84 and the light source 70. The operation of the switching circuit 110 is controlled by the state of a trigger signal 111 produced by the comparitor circuit 108. When the voltage V from the solar panel 40 is greater than the threshold voltage $T_v$, the voltage V is higher than the voltage output of the storage batteries 84, since the threshold voltage $T_v$ is at least as high as the battery voltage. When the solar panel voltage V is higher than the threshold voltage $T_v$, sufficient sunlight is present and the switching circuit 110 connects the flow of electricity from the solar panel 40 to the rechargeable storage batteries 84. During such daylight conditions, the solar panel 40 recharges the storage batteries 84 and no power is provided to the light source 70. When the amount of light energy impinging upon the solar panel 40 decreases, the state of the trigger signal 111 produced by the comparitor circuit 108 changes and signals the switching circuit 110 that the solar panel voltage V has dropped below that of the threshold voltage $T_v$. When the threshold voltage $T_v$ drops below the solar panel voltage V, it is assumed that the sun has set or a storm has approached. The switching circuit 110 then couples the storage batteries 84 to the light source 70, wherein the batteries empower the light source 70 causing the batteries to slowly drain. When the sun rises, the solar panel voltage V again rises over the threshold voltage $T_v$ and the batteries 84 are again charged. This cycle is repeated until the storage batteries 84 loose their ability to store and discharge electricity.

From the above description, it can be seen that the solar panel 40 is used as both a power source and as a light sensor. During conditions of strong light, the solar panels 40 recharge the storage batteries 84. In twilight, the solar panel detects the setting or rising of the sun, thereby appropriately controlling both the condition of the light source 70 and the recharging or discharging of the batteries 84.

It is a rare condition when the darkness of a storm during the day causes the same degree of darkness as does the setting of the sun at night. Consequently, the preferred embodiment of the control circuit 100 does not includes complicated and costly circuits that are specifically designed to determine the difference between cloudy conditions and sunny conditions. Rather, by using the solar panel 40 as the light sensor, the storage batteries 84 are charged whenever the voltage V from the solar panel 40 surpasses the set value of the threshold voltage $T_v$.

Figure 4:
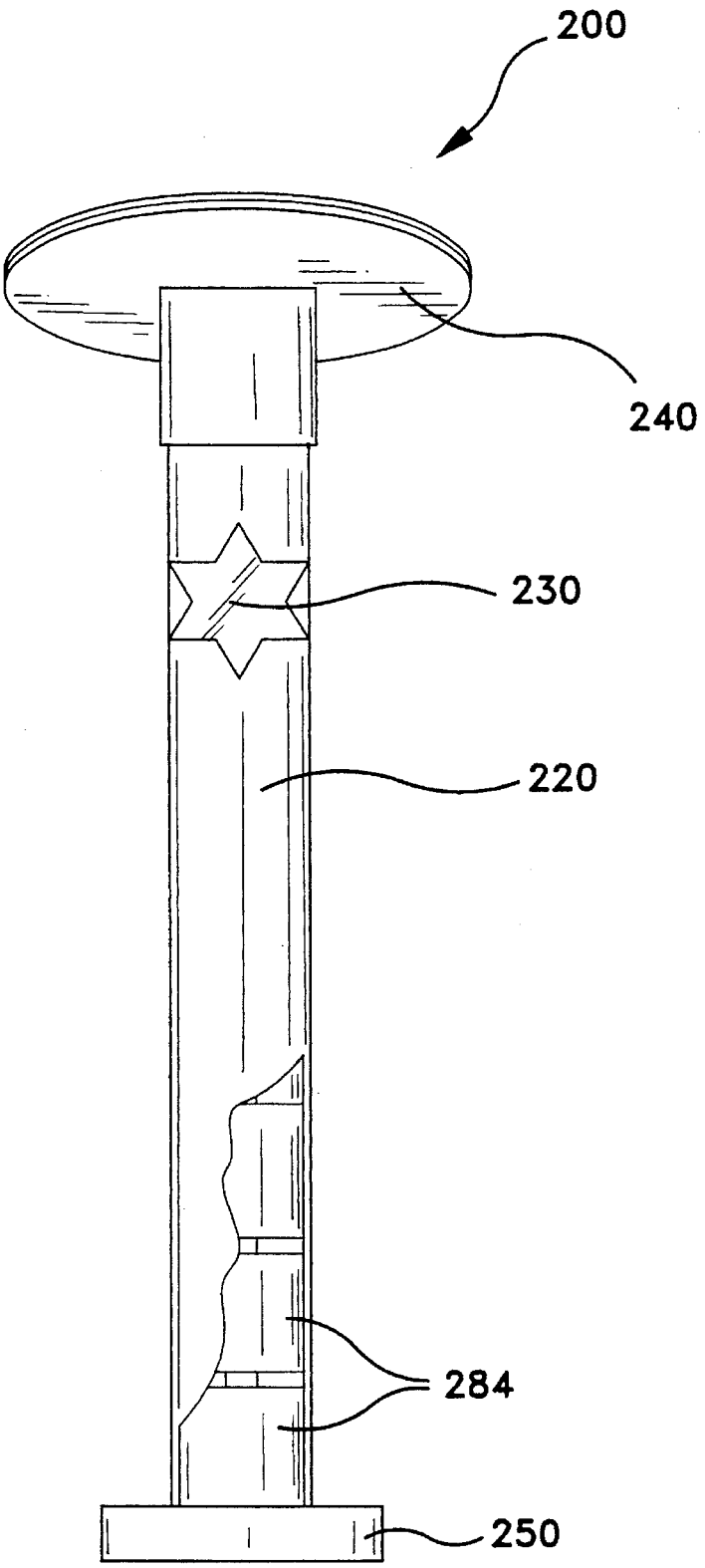
FIG. 4 is a partially fragmented view of an alternative embodiment of the present invention memorial.

Referring now to FIG. 4, an alternate embodiment of the present invention memorial 200 is shown, wherein the memorial 200 is not a cross structure. Rather, in the shown embodiment, the memorial 200 consists solely of a linear piece of tubing 220 that supports a solar panel 240. The purpose of describing this alternate embodiment is to show that the present invention need not be in the shape of a cross nor does it need to be constructed of circular tubing. In the shown embodiment, the ornamental aperture 230 is shaped as the Star of David to illustrate that any shape of religious icon can be used. Additionally, the linear piece of tubing 220 has a square cross-sectional profile to illustrate that and structure that defines a hollow interior could be used.

Since the shown embodiment does not have the side arms of a cross structure, the storage batteries 284 can be retained near the base of the piece of tubing 220. In such an orientation, the storage batteries 284 can be accessed by the selective uncoupling of the mounting flange 250 from the base mount upon which it rests.

It will be understood that the embodiments of the present invention memorial illustrated and described above are merely exemplary and many variations and modifications can be made by using functionally equivalent components and/or alternate embodiments. For instance, it will be understood by a person skilled in the art the a large variety of circuits could be created that are capable of performing the circuit logic described in regard to FIG. 3. All such circuits are intended to be included within the scope of the disclosure. Similarly, many of the described components, such as the LED light source, can be replaced with functionally equivalent components that have not been specifically described. All such variations and modifications are intended to be included within the scope of the invention as defined by the appended claims.

What is claimed is:

1. An illuminated memorial, comprising:

an opaque hollow structure having a first end and a second end and defining an internal region therebetween, wherein an aperture extends into said hollow structure at a point between said first end and said second end, exposing a portion of said internal region;

a mounting means disposed proximate said second end of said hollow structure for mounting said hollow structure to a tombstone;

a light source contained within said internal region proximate said aperture, whereby light emitted by said light source is directed through said aperture;

at least one rechargeable battery disposed within said hollow structure;

photovoltaic source supported at a predetermined height by said hollow structure, wherein said photovoltaic source converts light into electricity;

a control circuit coupled to said light source, said photovoltaic source and said rechargeable battery for selectively coupling said photovoltaic source to said rechargeable battery and said battery to said light source depending upon ambient lighting conditions.

2. The memorial according to claim 1, wherein said hollow structure is metal.

3. The memorial according to claim 2, wherein said metal is selected from a group consisting of stainless steel, titanium, aluminum alloy and tungsten alloy.

4. The memorial according to claim 1, wherein said hollow structure is comprised of at least one segment of tubing.

5. The memorial according to claim 1, wherein said aperture is shaped as a religious icon.

6. The memorial according to claim 1, further including a translucent element disposed over said aperture, whereby the light from said light source passes through said translucent element.

7. The memorial according to claim 6, wherein said translucent element is tinted in color.

8. The memorial according to claim 6, wherein said internal region is hermetically sealed.

9. The memorial according to claim 1, wherein said photovoltaic source is a solar panel that is supported by said hollow structure in a plane that is tilted at an acute angle relative to a horizontal plane.

10. The memorial according to claim 9, wherein said solar panel is covered by a protective transparent cover.

11. The memorial according to claim 9, wherein said solar panel is supported by a metal plate that is coupled to said first end of said hollow structure.

12. The monument according to claim 1, wherein said hollow structure includes a means for non-destructively accessing said at least one storage battery.

13. The memorial according to claim 1, wherein said hollow structure is a cross comprised of a central metal tube extending between said first end and said second end and two small pieces of tubing extending laterally from said central metal tube at a predetermined point between said first end and said second end.

14. The memorial according to claim 13 wherein said photovoltaic source is coupled to said first end of said cross, whereby said photovoltaic source is at the highest point associated with said memorial.

15. The memorial according to claim 1, wherein said hollow structure is a single piece of tubing extending between said first end and said second end and wherein said photovoltaic source is coupled to said first end at the highest point associated with said memorial. tubing through said translucent window.

16. An illuminated memorial, comprising:

a tombstone;

a piece of hollow tubing extending between a first end and a second end;

a translucent window disposed between said first end and said second end, exposing a section within said hollow tubing;

a mounting means coupled to said second end for mounting said hollow tubing in a generally vertical orientation onto said tombstone.; and a lighting means contained within said hollow tubing for producing light that shines out of said hollow tubing through said translucent window.

17. The memorial according to claim 16, wherein said lighting means includes a rechargeable electric source and said memorial further includes a photovoltaic source coupled to said first end of said hollow tubing, wherein said photovoltaic source recharges said rechargeable electric source.

18. The memorial according to claim 16 wherein said hollow tubing is metal.

19. An illuminated memorial, comprising:

an opaque hollow structure having a first end and a second end and defining an internal region therebetween, wherein an aperture extends into said hollow structure at a point between said first end and said second end, exposing a portion of said internal region;

a light source contained within said internal region proximate said aperture, whereby light emitted by said light source is directed through said aperture;

a translucent element disposed over said aperture, whereby the light from said light source passes through said translucent element;

at least one rechargeable battery disposed within said hollow structure;

photovoltaic source supported at a predetermined height by said hollow structure, wherein said photovoltaic source converts light into electricity;

a control circuit coupled to said light source, said photovoltaic source and said rechargeable battery for selectively coupling said photovoltaic source to said rechargeable battery and said battery to said light source depending upon ambient lighting conditions.

* * * * *